United States Patent [19]

Aasen et al.

[11] Patent Number: 4,649,807

[45] Date of Patent: Mar. 17, 1987

[54] METHOD FOR PREVENTING DUST DEPOSITIONS OR BUILD-UPS IN OFF-GAS CHANNELS OF ELECTROTHERMAL SMELTING FURNACES

[75] Inventors: Torbjorn Aasen; Bjarne Thogersen, both of Oslo, Norway

[73] Assignee: Elkem a/s, Oslo, Norway

[21] Appl. No.: 710,147

[22] Filed: Mar. 11, 1985

[30] Foreign Application Priority Data

Apr. 4, 1984 [NO] Norway ..... 841319

[51] Int. Cl.[4] ..... F23J 3/00

[52] U.S. Cl. ..... 98/58; 75/25; 110/160; 266/156; 266/157; 373/9

[58] Field of Search ..... 75/10 R, 25; 98/58, 98/60, 115.1; 110/160; 266/156, 157; 373/8, 9

[56] References Cited

U.S. PATENT DOCUMENTS 3,695,192 10/1972 Von Brimer ..... 110/160 X
3,792,998 2/1974 Norro ..... 373/9 X

FOREIGN PATENT DOCUMENTS 1102650 3/1961 Fed. Rep. of Germany .
2342844 3/1975 Fed. Rep. of Germany ..... 98/58

*Primary Examiner*—Harold Joyce
*Attorney, Agent, or Firm*—Lucas & Just

[57] ABSTRACT

A method for preventing deposits or build-ups of dust in off-gas channels for dust-containing off-gases from electrothermal smelting furnaces. This is done by blowing an additional gas tangentially into the furnace off-gas channels at the positions where build-ups or deposits of dust normally occurs. Hence a gas spiral is provided between the inner wall of the furnace off-gas channels and the dust-containing, hot furnace off-gas. Recirculated and cooled furnace off-gas is preferably used as additional gas. For open furnaces where the furnace off-gas is completely combusted before it enters into the furnace off-gas channels, air can be used as additional gas. The temperature of the additional gas is preferably kept below the sintering temperature of the dust in the furnace off-gas.

5 Claims, 3 Drawing Figures

METHOD FOR PREVENTING DUST DEPOSITIONS OR BUILD-UPS IN OFF-GAS CHANNELS OF ELECTROTHERMAL SMELTING FURNACES

The present invention relates to a method for preventing depositions or build-ups of dust in off-gas channels for electrothermal smelting furnaces.

In production of ferro alloys such as for example ferrosilicon in electrothermal smelting furnaces, the furnace off-gas has a high concentration of dust. Ferrosilicon has usually been produced in so-called open furnaces where air from the suroundings of the furnace is sucked into the open space between the smoke hood and the top of the furnace pot. The volume of air which in this way enters into the furnace is several hundred times greater than the gas which evolved from the furnace itself. This gives a complete and very fast combustion of combustible gases in the furnaces off-gas and also a very rapid cooling of the furnace off-gas. In addition the concentration of dust in the gas which enters into the furnace off-gas channels is reduced due to the increased gas volume.

For environmental reasons and also in order to reduce the total volume of off-gas, electrothermal smelting furnaces have in recent years been more and more closed and for some processes the furnaces are now completely closed.

As the furnaces now are more or less closed and thus a smaller amount of surrounding air is sucked into the furnaces, the concentration of dust in the off-gases has increased. This has lead to problems with depositions or build-ups of dust in the transition between the furnace roof or smoke hood and the off-gas channels. It has been tried to design the off-gas channels as streamlined as possible in order to get an even gas flow and it has also been tried to use materials in the off-gas channels which will prevent depositions or build-ups of dust. This has, however, not given a satisfactory solution to the depositions or build-ups of dust in the off-gas channels. In order to remove such depositions or build-ups it may be necessary to stop the furnace one to two times per shift. This gives a direct production loss and in addition, the downtime on the furnace will in itself give a poorer furnace operation.

The inventor has now found a method for preventing depositions or build-ups of dust on the walls in the off-gas channels of electrothermal smelting furnaces. Accordingly the present invention relates to a method for preventing depositions or build-ups of dust in off-gas channels for electrothermal smelting furnaces and the method is characterized in that additional gas is blown tangentially into the off-gas channels at the positions on the furnace off-gas channel which are exposed to such depositions or build-ups, whereby a surrounding gas spiral is provided between the inner wall of the off-gas channels and the dust-containing furnace off-gas.

Preferably cooled, recirculated furnace off-gas or air are used as additional gas. For completely closed furnaces where the furnace gas contains unburned explosive gases, cooled and unburned off-gas is used as additional gas. For open or semi-open furnaces air is used as additional gas.

The temperature of the additional gas which is blown into the off-gas channels is preferably kept below the sintering temperature of the dust in the dust-containing furnace off-gas.

The method of the present invention will now be further described with reference to the accompanying drawings which show by way of example an embodiment of the present invention.

Figure 1:
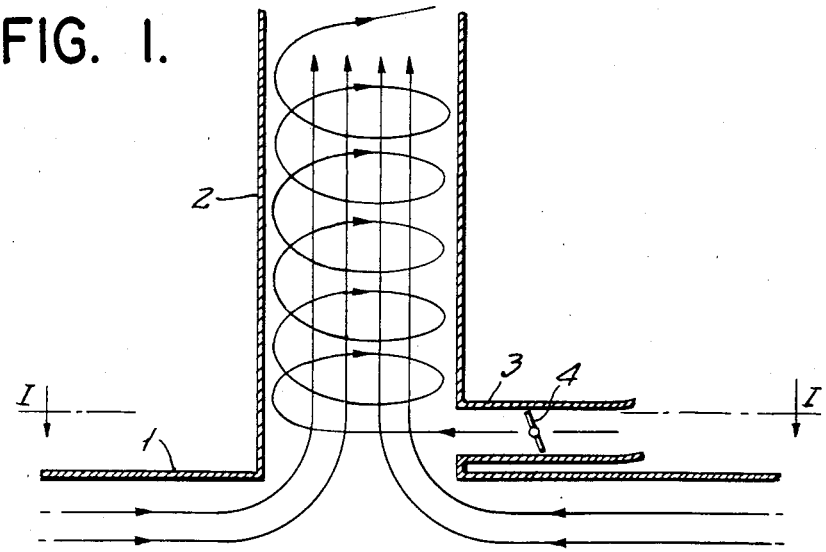
FIG. 1 is a vertical view of a part of a furnace roof and a furnace off-gas channel.
Figure 2:
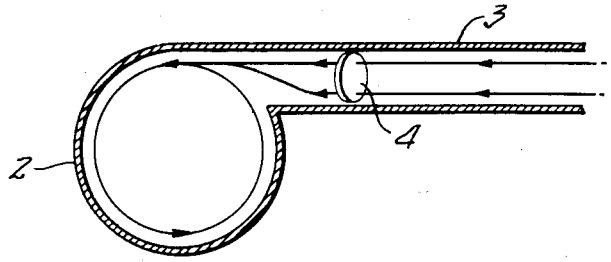
FIG. 2 is a horizontal view taken along line I—I in FIG. 1.
Figure 3:
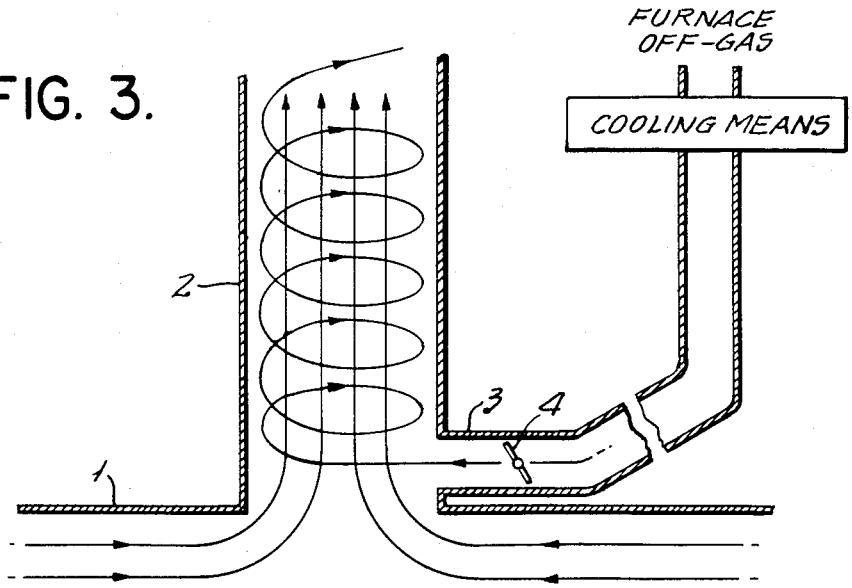
FIG. 3 is a vertical view of a part of a furnace roof and a furnace off-gas channel showing the cooling means.

On FIG. 1 a part of a furnace roof is indicated by reference numeral 1 having a furnace off-gas channel 2. Just above the furnace roof 1 there is provided a pipe 3 for blowing additional gas into the furnace off-gas channel 2. The pipe 3 is tangential in relation to the furnace off-gas channel 2. In the pipe 3 there is arranged a valve 4 for regulation of the flow-rate of additional gas.

In order to prevent depositions or build-ups of dust in the furnace off-gas channel 2, additional gas is blown through the pipe 3. The additional gas flows tangentially into the furnace off-gas channel and provids a surrounding gas spiral between the dust containing furnace off-gas and the inner wall of the furnace off-gas channel. This is shown by arrows on FIG. 1.

A flow pattern is then obtained which is almost non-turbulent as the furnace off-gas is put into a rotational movement. The hot, dust-containing furnace off-gas is thereby prevented from contact with the inner wall of the furnace off-gas channel and it will not be possible for the dust to deposit on the inner wall of the furnace off-gas channel. In addition the velocity of the surrounding gas spiral of the additional gas will remove any deposits or build-ups of dust on the wall. The temperature of the additional gas which is blown into the furnace off-gas channel is preperably kept below the sintering-temperature of the dust in the furnace off-gas.

What is claimed:

1. A method for preventing deposits or build-ups of dust in off-gas channels for electrothermal smelting furnaces, characterized in that at the positions on the furnace off-gas channels which are exposed to depositions or build-ups of dust contained in the furnace off-gas, blowing additional gas tangentially into the channels, thereby providing a surrounding gas spiral between the dust containing furnace off-gas and the inner walls of the furnace off-gas channels, said additional gas being provided at a temperature below the sintering temperature of the dust in the dust containing furnace off-gas.

2. A method for preventing deposition or build-ups of dust in off-gas channels for electrothermal smelting furnaces, characterized in that at the positions on the furnace off-gas channels which are exposed to depositions or build-ups of dust contained in the furnace off-gas, blowing additional gas tangentially into the channels, thereby providing a surrounding gas spiral between the dust containing furnace off-gas and the inner walls of the furnace off-gas channels, said additional gas being cooled, recirculated furnace off-gas.

3. A method according to claim 1, characterized in that air is used as additional gas.

4. A method according to claim 2, characterized in that the additional gas is cooled to a temperature below the sintering temperature of the dust in the dust-containing furnace off-gas.

5. An apparatus for preventing deposits or build-up of dust in off-gas channels in electrothermal smelting furnaces comprising:

a means for blowing additional gas to said channel such that said additional gas is blown tangentially into the channel causing the additional gas to spiral between the furnace off-gas and the inner wall of the channel, said additional gas being recirculated furnace off-gas; and means for cooling said recirculated furnace gas.

* * * * *